US007145081B2

(12) United States Patent
Suzuki et al.

(10) Patent No.: US 7,145,081 B2
(45) Date of Patent: Dec. 5, 2006

(54) ELECTRIC WIRE

(75) Inventors: Shigeharu Suzuki, Shizuoka (JP); Takeshi Kamata, Shizuoka (JP); Keigo Sugimura, Shizuoka (JP); Kiyoshi Yagi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/539,836

(22) PCT Filed: Dec. 25, 2003

(86) PCT No.: PCT/JP03/16709

§ 371 (c)(1),
(2), (4) Date: Jun. 17, 2005

(87) PCT Pub. No.: WO2004/059665

PCT Pub. Date: Jul. 15, 2004

(65) Prior Publication Data

US 2006/0102379 A1 May 18, 2006

(30) Foreign Application Priority Data

Dec. 25, 2002 (JP) ..... 2002-374218

(51) Int. Cl.
*H01B 7/36* (2006.01)

(52) U.S. Cl. ..... 174/112

(58) Field of Classification Search ..... 174/112, 174/120 R

See application file for complete search history.

(56) References Cited

U.S. PATENT DOCUMENTS 2,992,292 A * 7/1961 Brown ..... 174/112
3,197,554 A * 7/1965 Baker ..... 174/112
5,485,539 A 1/1996 Mills
6,173,100 B1 * 1/2001 Newton et al. ..... 385/102
2003/0194573 A1 * 10/2003 Itoh et al. ..... 428/461

FOREIGN PATENT DOCUMENTS

| | | |
|---|---|---|
| EP | 0 237 258 A2 | 9/1987 |
| JP | 57-147811 | 9/1982 |
| JP | 62-240589 | 10/1987 |
| JP | 1-176319 | 12/1989 |
| JP | 8-62468 | 3/1996 |
| JP | 10-269862 | 10/1998 |
| JP | 11-297129 | 10/1999 |
| JP | 2001-189112 | 7/2001 |
| JP | 2003-77346 | 3/2003 |

* cited by examiner

*Primary Examiner*—Chau N. Nguyen
(74) *Attorney, Agent, or Firm*—Armstrong, Kratz, Quintos, Hanson & Brooks, LLP

(57) ABSTRACT

An electric wire, in which a color of an outer surface of the electric wire is securely prevented from coming off, is provided. The electric wire (1) includes a core wire (4), coating (5), mark (23) and coating layer (6). The coating (5) coats the core wire (4). The mark (23) is formed on an outer surface (5*a*) of the coating (5). A coloring agent is allowed to adhere to the outer surface (5*a*), thereby forming the mark (23). The coating layer (6) is formed on the mark (23) and the outer surface (5*a*). The coating layer (6) consists of PVA. A thickness of the coating layer (6) consisting of PVA may be from 0.02 mm to 0.22 mm.

6 Claims, 7 Drawing Sheets

ELECTRIC WIRE

TECHNICAL FIELD

The present invention relates to an electric wire including an electrically conductive core wire, an insulating coating which coats the core wire, a mark formed on an outer surface of the coating, and a coating layer which coats the mark.

BACKGROUND ART

Various electronic devices are mounted on a motor vehicle as a mobile unit. Therefore, the motor vehicle is provided with a wiring harness for transmitting power from a power source and control signals from a computer to the electronic devices. The wiring harness includes a plurality of electric wires and connectors attached to an end of the wires.

The wire includes an electrically conductive core wire and a coating made of insulating synthetic resin, which coats the core wire. The wire is a so-called coated wire. A connector includes an electrically conductive terminal fitting and an electrically insulating connector housing. The terminal fitting is attached to an end of the wire and electrically connected to the core wire of the wire. The connector housing is formed in a box-shape and receives the terminal fitting therein.

When the wiring harness is assembled, first the wire is cut into a specific length and then the terminal fitting is attached to an end of the wire. A wire is connected to another wire according to the need. Afterward, the terminal fitting is inserted into the connector housing, thereby assembling the wiring harness.

The wire of the wiring harness must be distinguished in terms of the size of the core wire, the material of the coating (concerning with alteration in the materials depending upon heat-resisting property), and a purpose of use. The purpose of use means, for example, an air bag, antilock brake system (ABS), control signal such as speed data, and system in a motor vehicle in which the wire is used, such as a power transmission system.

So far, in order to distinguish the purpose of use (or system) as described above, for example, an outer surface of the electric wire of the wiring harness is formed to have a stripe pattern with two different colors. In this case, when the coating is formed by extruding synthetic resin onto the periphery of the core wire so as to coat the core wire, first a coloring agent having a desired color is mixed into the synthetic resin that constitutes the coating. Then, another coloring agent having a color different from that of said desired color is applied on the synthetic resin (i.e. on a part of the outer surface of the coating). Thus, the part of the outer surface of the coating is colored so as to color the electric wire in a stripe pattern.

Generally, a motor vehicle is used for a long period of time from several years to more than ten years. Further, a motor vehicle may be used in various regions such as very cold regions or very hot regions. Therefore, if the electric wire used in a motor vehicle is colored in a stripe pattern, the coloring agent, particularly the coloring agent which is applied later, tends to come off from the outer surface of the electric wire as time passes.

Further, since the motor vehicle is used for a long period of time as described above, it happens that a new electronic instrument is added thereinto during use. Therefore, if the coloring agent comes off from the outer surface of the electric wire, it becomes difficult to distinguish the electric wires from one another, resulting in that it becomes difficult to electrically connect the additional electric instrument to a desired electric wire. That is, it is demanded that the color of the outer surface of the electric wire used in a motor vehicle does not come off in severe circumstances for a long period of time.

It is therefore an objective of the present invention to provide an electric wire, in which a color of the outer surface of the electric wire is securely prevented from coming off.

DISCLOSURE OF THE INVENTION

In order to solve the above problem and to attain the above objective, the present invention is an electric wire including:

an electrically conductive core wire;

a coating consisting of synthetic resin for coating the core wire;

a mark formed on a part of an outer surface of the coating by allowing a coloring agent to adhere to the part; and a coating layer formed on the mark and the outer surface of the coating, the coating layer coating the mark, wherein the coating layer consists of polyvinylalcohol.

The present invention is an electric wire wherein a thickness of the coating layer is from 0.02 mm to 0.22 mm.

The present invention is an electric wire wherein a thickness of the coating layer is from 0.023 mm to 0.22 mm.

The present invention is an electric wire including:

an electrically conductive core wire;

a coating consisting of synthetic resin for coating the core wire;

a mark formed on a part of an outer surface of the coating by allowing a coloring agent to adhere to the part; and a coating layer formed on the mark and the outer surface of the coating, the coating layer coating the mark, wherein the coating layer consists of ethylene-vinylalcohol copolymer.

The present invention is an electric wire wherein thickness of the coating layer is from 0.03 mm to 0.175 mm.

The present invention is an electric wire wherein a thickness of the coating layer is from 0.1 mm to 0.175 mm.

In the electric wire of the present invention, the coating layer is formed on the mark formed on the outer surface of the electric wire. The coating layer consists of polyvinylalcohol.

In this specification, the coloring agent means a liquid substance, in which a coloring material (organic substance for use in industry) is dissolved and dispersed in a solvent except water. The organic substance described above is a dye or a pigment (most of them being organic substances and synthetic substances). Sometimes, a dye is used as a pigment and a pigment is used as a dye. As an example, the coloring agent may be a coloring liquid or coating material.

The coloring liquid is a liquid, in which a dye is dissolved or dispersed in a solvent. The coating material is a material, in which a pigment is dispersed in a liquid dispersion. When the outer surface of the coating is colored with a coloring liquid, the dye permeates into the coating. When the outer surface of the coating is colored with a coating material, the pigment adheres to the outer surface without permeating into the coating. In the specification, "to color the outer surface of the coating" means to dye the whole or a part of the outer surface of the wire with a dye or, alternatively, to coat the whole or a part of the outer surface of the wire with a pigment.

Preferably, the solvent and liquid dispersion have an affinity to the synthetic resin that constitutes the coating in order to allow the dye to securely permeate into the coating or to allow the pigment to securely adhere to the outer surface of the coating. The dye of the coloring liquid and the pigment of the coating material are oil-soluble. That is, the dye of the coloring liquid does not dissolve or disperse in water. The pigment of the coating material does not dissolve in water.

Since the dye of the coloring liquid and the pigment of the coating material are oil-soluble, the coloring agent hardly passes through the coating layer consisting of water-soluble polyvinylalcohol. Therefore, the coating layer prevents the coloring agent, which forms the mark, from coming off from the outer surface of the electric wire.

In the electric wire of the present invention, a thickness of the coating layer is from 0.02 mm to 0.22 mm. Therefore, the coating layer securely prevents the coloring agent, which forms the mark, from coming off from the outer surface of the electric wire.

In the electric wire of the present invention, a thickness of the coating layer is from 0.023 mm to 0.22 mm. Therefore, the coating layer more securely prevents the coloring agent, which forms the mark, from coming off from the outer surface of the electric wire.

In the electric wire of the present invention, the coating layer is formed on the mark formed on the outer surface of the electric wire. The coating layer consists of ethylene-vinylalcohol copolymer. Since the dye of the coloring liquid and the pigment of the coating material are oil-soluble, the coloring agent hardly passes through the coating layer consisting of water-soluble ethylene-vinylalcohol. Therefore, the coating layer prevents the coloring agent, which forms the mark, from coming off from the outer surface of the electric wire.

In the electric wire of the present invention, a thickness of the coating layer is from 0.03 mm to 0.175 mm. Therefore, the coating layer securely prevents the coloring agent, which forms the mark, from coming off from the outer surface of the electric wire.

In the electric wire of the present invention, a thickness of the coating layer is from 0.1 mm to 0.175 mm. Therefore, the coating layer more securely presents the coloring agent, which forms the mark, from coming off from the outer surface of the electric wire.

BEST MODE FOR CARRING OUT THE INVENTION

In the following, an electric wire according to a preferred embodiment of the present invention will be explained with reference to FIGS. 1–10.

Figure 5:
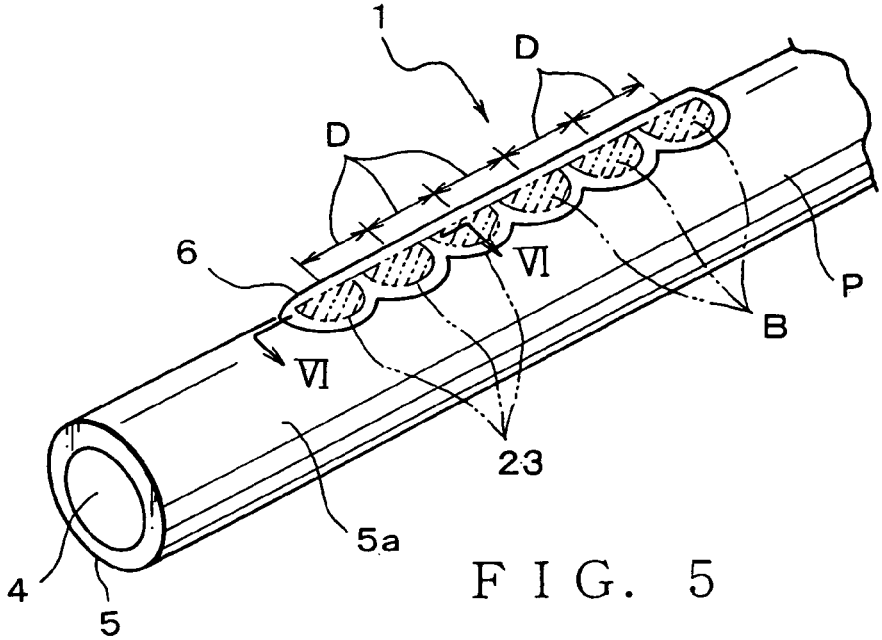
FIG. 5 is a perspective view of an electric wire according to a preferred embodiment of the present invention.
Figure 6:
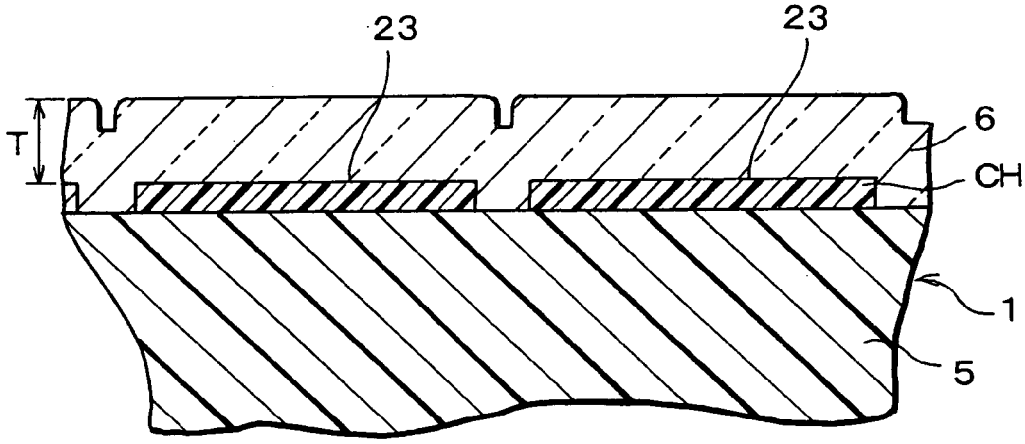
FIG. 6 is a cross sectional view taken along VI—VI line in FIG. 5.
Figure 8:
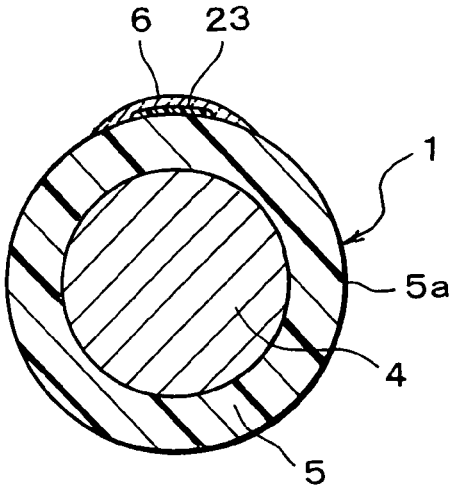
FIG. 8 is a cross sectional view taken along VIII—VIII line in FIG. 7.

An electric wire 1 constitutes a wiring harness to be mounted on a motor vehicle or the like as a mobile unit. As shown in FIG. 5 and so on, the wire 1 includes an electrically conductive core wire 4 and an electrically insulating coating 5. A plurality of element wires are bundled up to form the core wire 4. Each element wire of the core wire 4 is made of electrically conductive metal.

The core wire 4 may be constituted by a single element wire. The coating 5 is made of synthetic resin such as polyvinyl chloride (PVC). The coating 5 coats the core wire 4. Therefore, the outer surface 5*a* of the coating 5 means an outer surface of the wire 1.

The outer surface 5*a* of the coating 5 has a monochrome color P. A desired coloring agent may be mixed with the synthetic resin of the coating 5 so as to make the color of the outer surface 5*a* of the wire 1 be a monochrome color P, or alternatively, the monochrome color P may be set as the color of the synthetic resin itself without adding a coloring agent to the synthetic resin of the coating 5. That is, the wire 1 may not be colored.

If a coloring agent is not mixed into the synthetic resin which constitutes the coating 5, that is, if the monochrome color P is a color of the synthetic resin itself, the outer surface 5*a* of the coating 5 that is, the outer surface 5*a* of the electric wire 1 is called non-colored.

Figure 7:
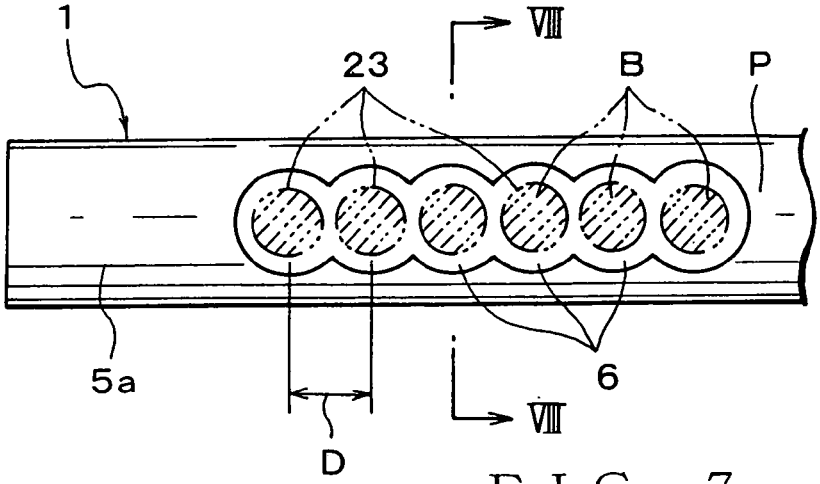
FIG. 7 is a plan view of the electric wire shown in FIG. 5.

The electric wire 1 includes a plurality of marks 23 and a coating layer 6. Each mark 23 is formed on a part of the outer surface 5*a* of the coating 5. As shown in FIG. 7, a shape of the mark 23 in its plan view is round. A plurality of the marks 23 are arranged along the longitudinal direction of the wire 1 in a predetermined pattern. A distance D between centers of the two marks 23 adjacent to each other and a size of each mark 23 are predetermined.

The mark 23 has a color B (shown with a parallel alternate long and two short dashes line in FIGS. 5 and 7). The color B is different from the monochrome color P. A coloring agent CH (explained later on) is allowed to adhere to a part of the outer surface 5*a* of the wire 1, thereby forming the mark 23. The wires 1 are distinguishable from one another by changing the colors B of the marks 23 in various manners. The color B is used to distinguish types of the wires of a wiring harness or systems in which the wires 1 are used.

As shown in FIGS. 5–8, the coating layer 6 is formed on the respective marks 23 so as to coat the marks 23. The coating layer 6 is formed on the marks 23 and on the outer surface 5*a* of the coating 5. The coating layer 6 prevents a dye or a pigment (explained later on), which constitutes the mark 23, from coming off from the outer surface 5*a*.

The coating layer 6 consists of polyvinylalcohol (PVA). A thickness T (see FIG. 6) of the coating layer 6 may be from 0.02 mm to 0.22 mm.

A plurality of the electric wires 1 are bundled up with each other, then connectors or the like are attached to ends of the wires 1, thereby constituting the wiring harness. Such connectors are coupled with connectors of various electronic instruments in a motor vehicle or the like, thereby the wiring harness transmits various signals and electric power to the respective electronic instruments.

Figure 1:
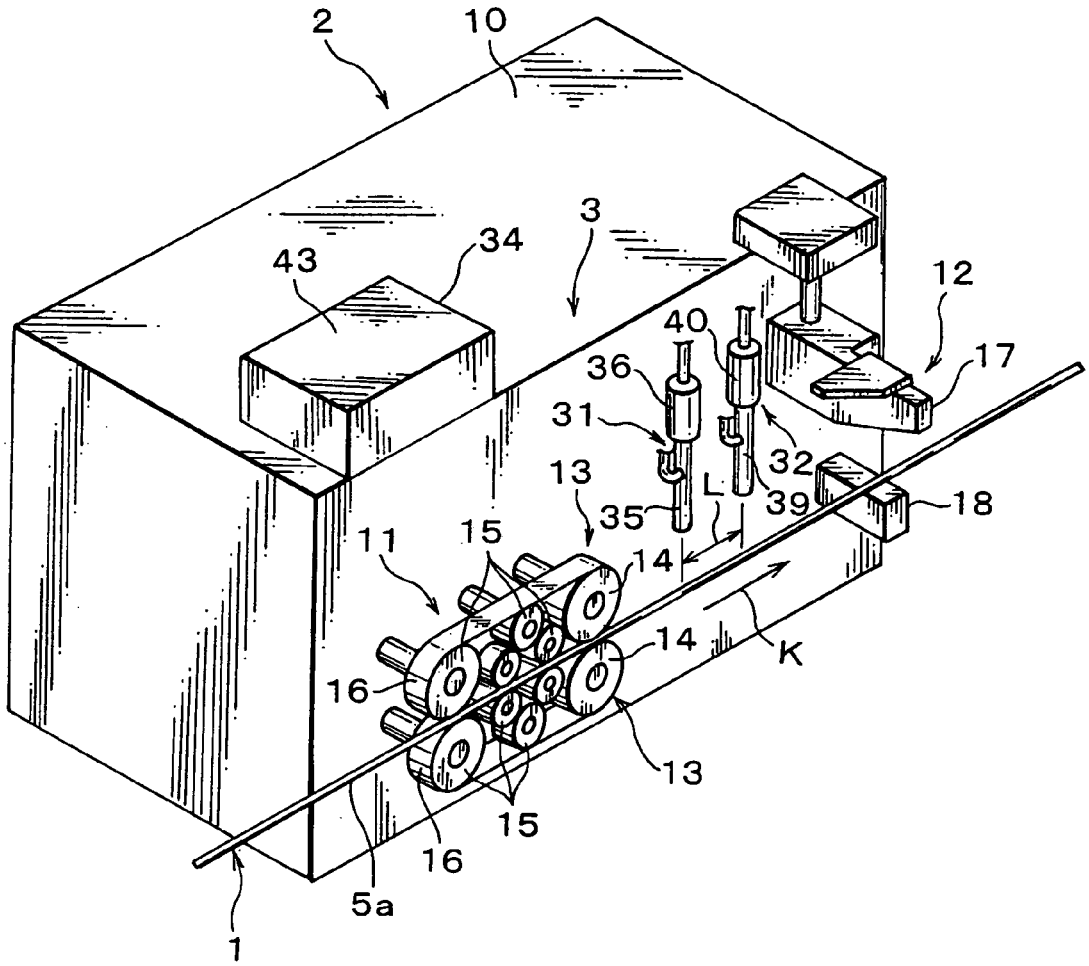
FIG. 1 is a perspective view illustrating a structure of an electric wire-cutting device for obtaining an electric wire according to a preferred embodiment of the present invention.

A long electric wire, on which the marks 23 and coating layer 6 are not formed, is cut by the electric wire-cutting device 2 shown in FIG. 1 into a specific length, thereby the electric wire 1 is obtained. A coating device 3 is mounted on the electric wire-cutting device 2. The coating device 3 forms the marks 23 and the coating layer 6 on the outer surface 5*a* of the wire 1, which is cut into the specific length by the electric wire-cutting device 2.

As shown in FIG. 1, the electric wire-cutting device 2 includes a body 10, sizing mechanism 11 and cutting mechanism 12. The body 10 is formed in a box-shape. The sizing mechanism 11 includes a pair of belt-forwarding units 13.

Each belt-forwarding unit 13 includes a driving pulley 14, a plurality of idler pulleys 15 and a non-end belt 16 (i.e. a belt 16 having no end). The driving pulley 14 is rotated by a motor which is a driving source received in the body 10. The idler pulleys 15 are rotatably supported by the body 10. The non-end belt 16 is a circle-shaped belt and hung over the driving pulley 14 and the idler pulleys 15. The non-end belt 16 rotates around the driving pulley 14 and the idler pulleys 15.

The pair of the belt-forwarding units 13 is arranged in the vertical direction. The pair of the belt-forwarding units 13 puts the wire 1 therebetween and allows the pulleys 14 to rotate reversely to each other synchronously with the same number of revolution, so that the non-end belt 16 is rotated to forward the wire 1 by a specific length thereof.

At this time, the pair of the belt-forwarding units 13 moves the wire 1 along an arrow K shown in FIG. 1, which is parallel to the longitudinal direction of the wire 1. That is, the pair of the belt-forwarding units 13 moves the wire 1 along the longitudinal direction of the wire 1.

The cutting mechanism 12 is disposed on the downstream side of the belt-forwarding units 13 along the arrow K. The cutting mechanism 12 includes a pair of cutting blades 17, 18. The pair of cutting blades 17, 18 is arranged in the vertical direction. That is, the pair of cutting blades 17, 18 approaches toward or leaves away from each other in the vertical direction. When the pair of cutting blades 17, 18 approaches toward each other, the pair of cutting blades 17, 18 puts the wire 1, which is forwarded by the pair of the belt-forwarding units 13, therebetween and cuts the wire 1. When the pair of cutting blades 17, 18 leaves away from each other, each blade 17, 18 leaves away from the wire 1.

In the electric wire-cutting device 2, the pair of the belt-forwarding units 13 puts the wire 1 therebetween in a state that the pair of cutting blades 17, 18 of the cutting mechanism 12 is parted away from each other, so that the wire 1 is forwarded along the arrow K. After the wire 1 of a specific length thereof is forwarded, the driving pulleys 14 of the belt-forwarding units 13 are halted. Then, the pair of cutting blades 17, 18 approaches toward each other, puts the wire 1 therebetween and cuts the wire 1. Thus, the electric wire-cutting device 2 moves the wire 1 along the arrow K.

Figure 2:
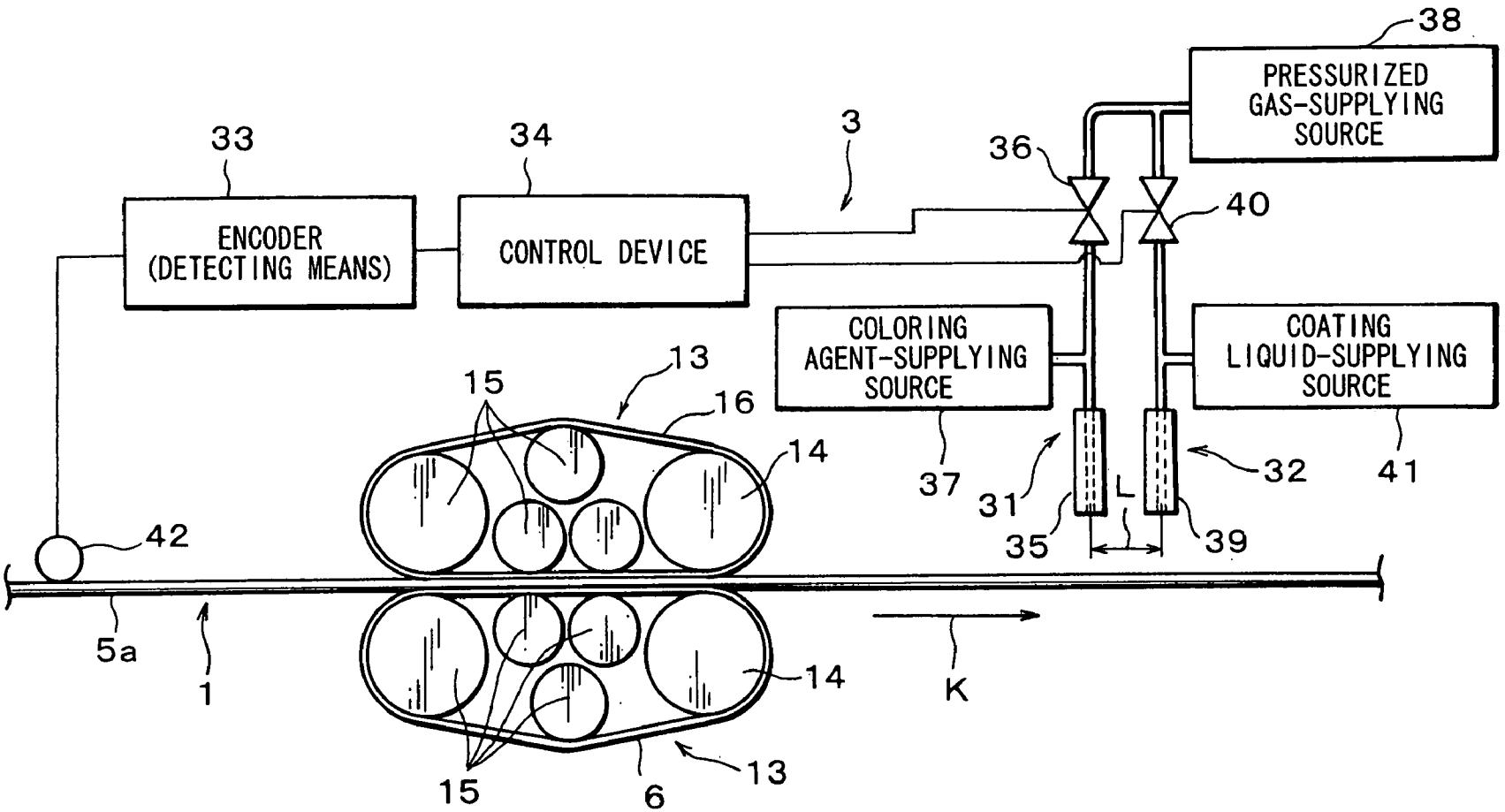
FIG. 2 is a view illustrating a structure of an electric wire-coating device mounted on the electric wire-cutting device shown in FIG. 1.

In the coating device 3, the marks 23 are formed on the outer surface 5*a* of the wire 1, thereafter the coating layer 6 is formed on the marks 23 and on the outer surface 5*a*. As shown in FIG. 2, the coating device 3 includes a coloring agent-spouting unit 31 as coloring agent-spouting means, a spouting unit 32 as spouting means, an encoder 33 as detecting means, and a control device 34. The coloring agent-spouting unit 31 and the spouting unit 32 are arranged along the arrow K.

As shown in FIG. 1, the coloring agent-spouting unit 31 is disposed between the belt-forwarding units 13 and the pair of cutting blades 17, 18. As shown in FIG. 2, the coloring agent-spouting unit 31 includes a nozzle 35 and a valve 36. The nozzle 35 faces the wire 1, which is moved along the arrow K by the belt-forwarding units 13. A coloring agent CH (shown in FIG. 4) is supplied into the nozzle 35 from a coloring agent-supplying source 37 (shown in FIG. 2). The coloring agent CH has the color B as described above.

The valve 36 is linked to the nozzle 35. The valve 36 is also linked to a pressurized gas-supplying source 38 (shown in FIG. 2). The pressurized gas-supplying source 38 supplies pressurized gas to the nozzle 35 by way of the valve 36. Further, the pressurized gas-supplying source 38 supplies pressurized gas to a nozzle 39 (explained later on) by way of a valve 40 (explained later on). When the valve 36 is opened, the pressurized gas supplied from the pressurized gas-supplying source 38 causes the coloring agent CH in the nozzle 35 to spout out from the nozzle 35 toward the outer surface 5*a* of the wire 1.

Figure 4:
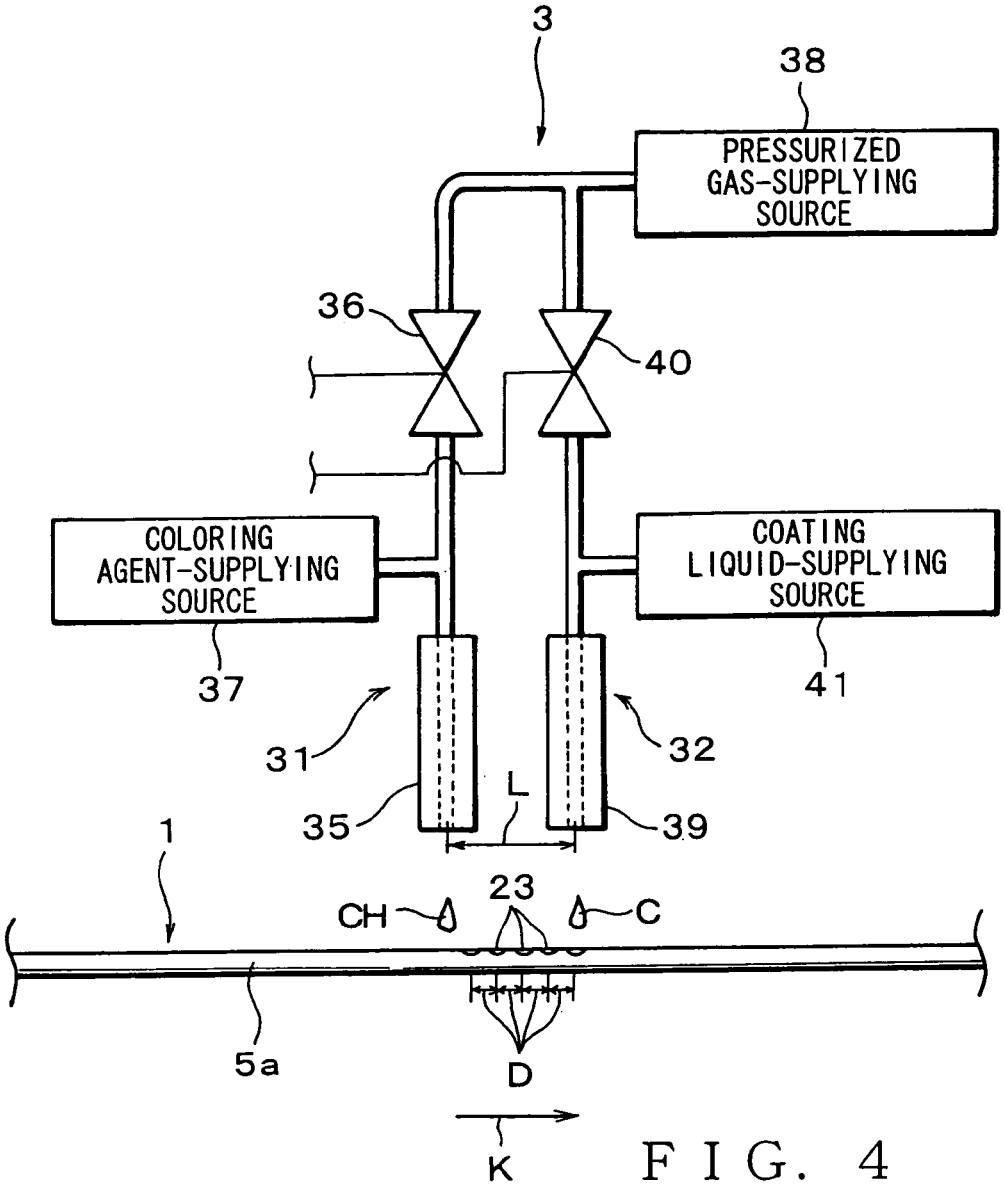
FIG. 4 is a view illustrating a state when a spouting unit of the electric wire-coating device shown in FIG. 2 is in action.

When the valve 36 is closed, the spouting of the coloring agent CH from the nozzle 35 is halted. As shown in FIG. 4, in the coloring agent-spouting unit 31, the valve 36 is opened for a predetermined period of time in response to a signal transmitted from a CPU 47 (explained later on) of the control device 34, so that a specific amount of the coloring agent CH is spouted toward the outer surface 5*a* of the wire 1.

The coloring agent CH is a liquid substance, in which a coloring material (organic substance for use in industry) is dissolved and dispersed in a solvent except water. The organic substance described above is a dye or a pigment (most of them being organic substances and synthetic substances). Sometimes, a dye is used as a pigment and a pigment is used as a dye. As an example, the coloring agent may be a coloring liquid or coating material. The coloring liquid is a liquid, in which a dye is dissolved or dispersed in a solvent. The coating material is a material, in which a pigment is dispersed in a liquid dispersion.

When the outer surface 5*a* of the wire 1 is colored with a coloring liquid, the dye permeates into the coating 5. When the outer surface 5*a* of the wire 1 is colored with a coating material, the pigment adheres to the outer surface 5*a* without permeating into the coating 5. The dye of the coloring liquid and the pigment of the coating material are oil-soluble. That is, the dye of the coloring liquid does not dissolve or disperse in water. The pigment of the coating material does not dissolve in water.

That is, the coloring agent-spouting unit 31 dyes a part of the outer surface 5*a* of the wire 1 with a dye or coats a part of the outer surface 5*a* of the wire 1 with a pigment. That is, to mark the outer surface 5*a* of the wire 1 (i.e. to form the marks 23) means to dye a part of the outer surface 5*a* of the wire 1 with a dye or to coat a part of the outer surface 5*a* of the wire 1 with a pigment.

Preferably, the solvent and liquid dispersion have an affinity to the synthetic resin that constitutes the coating 5 in order to allow the dye to securely permeate into the coating 5 or to allow the pigment to securely adhere to the outer surface 5*a*.

As shown in FIG. 1, the spouting unit 32 is disposed between the belt-forwarding units 13 and the pair of cutting blades 17, 18 and situated further from the belt-forwarding units 13 than the coloring agent-spouting unit 31 is situated.

That is, the coloring agent-spouting unit 31 is disposed on the upstream side of the spouting unit 32 along the moving direction of the wire 1.

As shown in FIG. 2, the spouting unit 32 includes a nozzle 39 and a valve 40. The nozzle 39 faces the wire 1, which is forwarded along the arrow K by the belt-forwarding units 13. A coating liquid C (shown in FIG. 4) is supplied into the nozzle 39 from a coating liquid-supplying source 41 (shown in FIG. 2). The coating liquid C is transparent.

The valve 40 is linked to the nozzle 39. The valve 40 is also linked to the pressurized gas-supplying source 38. When the valve 40 is opened, the pressurized gas supplied from the pressurized gas-supplying source 38 causes the coating liquid C in the nozzle 39 to spout out from the nozzle 39 toward the outer surface 5*a* of the wire 1. When the valve 40 is closed, the spouting of the coating liquid C from the nozzle 39 is halted. As shown in FIG. 4, in the spouting unit 32, the valve 40 is opened for a predetermined period of time in response to a signal transmitted from the CPU 47 of the control device 34, so that a specific amount of the coating liquid C is spouted toward the outer surface 5*a* of the wire 1.

The coating liquid C consists of a coating agent and solvent for dissolving the coating agent. The coating liquid C is in sol-form or gel-form. The coating agent consists of PVA, which constitutes the coating layer 6.

Water, acetone or 2-propyl alcohol can be used as the solvent for dissolving the coating agent. The solvent for dissolving the coating agent can be selected appropriately according to PVA, which is used as the coating agent.

As shown in FIG. 2, the encoder 33 includes a rotor 42. The rotor 42 is rotatable around an axis. An outer peripheral surface of the rotor 42 comes in contact with the outer surface 5*a* of the wire 1, which is put between the pair of the belt-forwarding units 13. When the wire 1 is forwarded along the arrow K, the rotor 42 rotates. The forwarded distance of the wire 1 along the arrow K is proportional to the number of revolution of the rotor 42.

The encoder 33 is linked to the control device 34. When the rotor 42 rotates per a specific angle, the encoder 33 outputs a pulse-shaped signal to the control device 34. That is, the encoder 33 outputs information to the control device 34 in response to the moving speed of the wire 1 along the arrow K.

Thus, the encoder 33 measures information in response to the moving speed of the wire 1 and outputs the information to the control device 34. Normally, encoder 33 outputs pulse signal in response to the forwarded distance of the wire 1 with friction between the wire 1 and the rotor 42 (i.e. roll attached to the encoder). However, in the event that the forwarded distance of the wire 1 does not coincide with the number of the pulse due to a condition of the outer surface 5*a* of the wire 1, the speed information may be obtained at a different position in a different manner.

Figure 3:
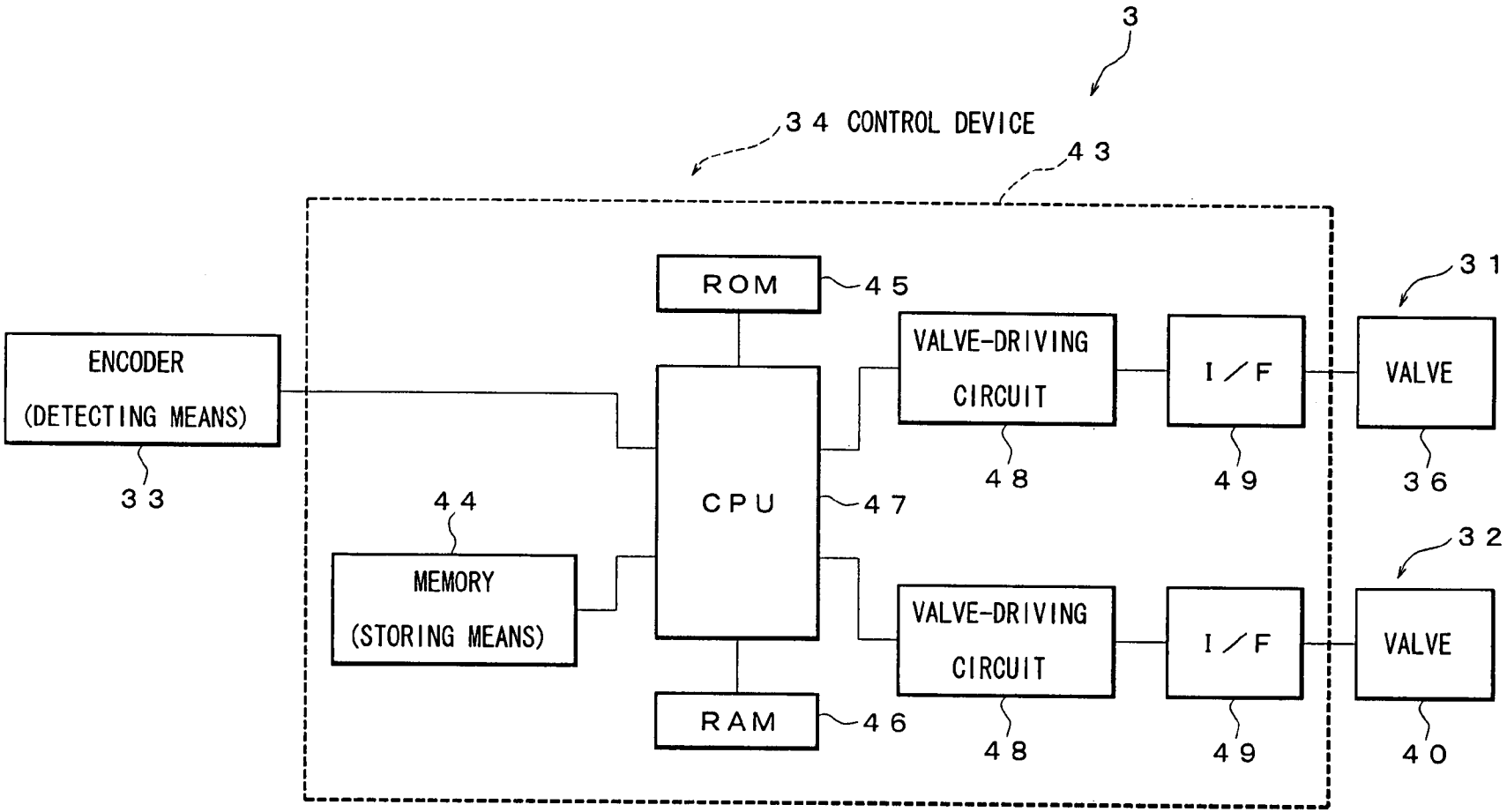
FIG. 3 is a view illustrating a structure of a control device of the electric wire-coating device shown in FIG. 2.

As shown in FIG. 3, the control device 34 includes a box-shaped device body 43 (shown in FIG. 1), memory 44 as storing means, known ROM (Read-only Memory) 45, RAM (Random Access Memory) 46, CPU (Central Processing Unit) 47, a plurality of valve-driving circuits 48, and a plurality of interfaces (indicating as I/F in FIG. 3; hereinafter I/F) 49 as connectors. The control device 34 is a computer.

The control device 34 is linked to the encoder 33 and valves 36, 40 of the respective spouting units 31, 32 so as to control the whole of the coating device 3. The device body 43 receives the memory 44, ROM 45, RAM 46 and CPU 47. The memory 44 stores a pattern of the marks 23 to be formed on the outer surface 5*a* of the wire 1.

Concretely, the memory 44 stores: a position at which the mark 23 located most downstream along the arrow K is formed among the marks 23 to be formed on the outer surface 5*a* of the wire 1; the number of the marks 23; the distance D between the centers of the two marks adjacent to each other; a degree of opening of the valve 36 required for forming one mark 23; and a time period for which the valve 36 is kept open.

The memory 44 further stores: a degree of opening of the valve 40 required for allowing the nozzle 39 to spout the coating liquid C with an amount which enables to coat the marks 23 with giving a desired thickness of the mark 23; a time period for which the valve 40 is kept open; and a distance L between the nozzle 35 and the nozzle 39.

The distance L also correspond to a distance between the spouting units 31 and 32, that is, a distance between the coloring agent-spouting means and the spouting means. The memory 44 may consist of a known nonvolatile storage such as an EEPROM. The ROM 45 stores an action program of the CPU 47. The RAM 46 temporarily holds data, which are necessary upon computation of the CPU 47.

The CPU is the control means. The CPU receives information of the moving speed of the wire 1 from the encoder 33. The CPU 47 also receives the pattern of the marks 23 from the memory 33. The CPU 47 also receives the distance L, the degree of opening of the valve 40 as described above, and a time period for which the valve 40 is kept open. The CPU 47 opens the valve 36 in a timing, at which the mark 23 situated at the most downstream along the arrow K is formed at a specific position, on the basis of the moving speed of the wire 1, which is inputted from the encoder 33.

The CPU 47 opens or closes the valve 36 so that the distance between the centers of the marks 23 formed on the outer surface 5*a* of the wire 1 becomes to the distance D described above in response to the moving speed of the wire 1, which is inputted from the encoder 33. Further, the CPU 47 opens the valve 36 for the time period stored by the memory 44 with the degree of opening stored by the memory 44, which allows a size of the mark 23 to be formed on the outer surface 5*a* of the wire 1 to become a predetermined size. Thus, the CPU 47 allows the coloring agent-spouting unit 31 to spout the coloring agent CH toward the outer surface 5*a* of the wire 1 so as to form the marks 23.

The CPU 47 judges whether or not the wire 1 moves by the distance L after the valve 36 is once opened in response to the moving speed of the wire 1, which is inputted from the encoder 33. When the CPU 47 judges that the wire 1 moves by the distance L after the valve 36 is once opened, the CPU 47 opens the valve 40 with the degree of opening stored by the memory 44, which allows the coating layer 6 coats the marks 23 with giving a desired thickness T of the coating layer 6.

Further, after the CPU 47 opens the valve 40 for the time period stored by the memory 44, the CPU 47 closes the valve 40. Thus, the CPU 47 controls the spouting unit 32 so that the coating liquid C coats the marks 23, that is, the coating liquid C coats the coloring agent that adheres to the outer surface 5*a* of the wire 1. The CPU 47 allows the spouting unit 32 to spout the coating liquid C toward the coloring agent that adheres to the outer surface 5*a* of the wire 1.

The valve-driving circuits 48 and the I/F 49 are provided as many as the spouting units 31, 32, to which the valve-driving circuits 48 and the I/F 49 correspond. The valve-driving circuits 48 are linked to the CPU 47. The valve-driving circuits 48 are linked to the respective valves 36, 40 of the corresponding spouting units 31, 32 by way of the I/F 49.

When the valve-driving circuit 48 receives a signal for opening the corresponding valve 36 or 40 from the CPU 47, the valve-driving circuit 48 outputs the signal to the valve 36 or 40 by way of the I/F 49, thereby opening the valve 36 or 40.

Thus, the I/F 49 is used to electrically connect the valve-driving circuit 48 to the corresponding valve 36 or 40. The I/F is attached on an outer wall of the device body 43 or the like.

After the coating device 3 forms the marks 23 on the outer surface 5*a* of the wire 1, when the coating layer 6 is formed on the marks 23, the pair of the belt-forwarding units 13 of the electric wire-cutting device 2 forwards the wire 1 along the arrow K. When the CPU 47 receives a pulse-shaped signal of a specific order from the encoder 33, first, the CPU allows the valve 36 to open and close six times according to the distance D with the degree of opening stored in the memory 44 for the time period stored in the memory 44.

Then, as shown in FIG. 4, the coloring agent-spouting unit 31 spouts the coloring agent CH toward the outer surface 5*a* of the wire 1 with a specific amount thereof at a time. When the coloring agent CH adheres to the outer surface 5*a* of the wire 1, the solvent or the liquid dispersion thereof evaporates, so that the dye permeates or the pigment adheres to the outer surface 5*a* of the wire 1.

After the valve 36 of the coloring agent-spouting unit 31 once opens, when the CPU 47 judges that the wire 1 moves by the distance L on the basis of the moving speed of the wire 1 transmitted from the encoder 33, CPU allows the valve 36 to open and close according to the distance D with the degree of opening stored in the memory 44 for the time period stored in the memory 44.

Then, as shown in FIG. 4, the spouting unit 32 spouts the coating liquid C toward the marks 23 adhering to the outer surface 5*a* of the wire 1, that is, toward the coloring agent CH with a specific amount thereof at a time. After the valve 36 of the coloring agent-spouting unit 31 once opens, when the wire 1 moves by the distance L, the CPU 47 allows the valve 40 of the spouting unit 32 to open or close. The coating liquid C that adheres to the outer surface 5*a* of the wire 1 coats the marks 23 with the coating agent after the solvent thereof evaporates. Thus, the coating layer 6 is formed on the marks 23 and on the outer surface 5*a* of the wire 1.

Then, after the pair of the belt-forwarding units 13 of the electric wire-cutting device 2 forwards the wire 1 by a specific length thereof, the pair of the belt-forwarding units 13 halts. The cutting blades 17, 18 of the cutting mechanism 12 cuts the wire 1, in which the marks 23 are formed on the outer surface 5*a* of the wire 1, thereby obtaining the wire 1 shown in FIG. 5, in which the marks 23 are formed on the outer surface 5*a* of the wire 1 and the marks 23 are coated with the coating layer 6.

In the preferred embodiment, the coating layer 6 is formed on the marks 23 that are formed on the outer surface 5*a* of the wire 1. The coating layer 6 consists of PVA. Since the dye of the coloring liquid or the pigment of the coating material as the coloring agent CH is oil-soluble, the coloring agent CH hardly passes through the coating layer 6 consisting of water-soluble PVA (polyvinylalcohol).

Therefore, the coating layer 6 prevents the coloring agent CH, which forms the marks 23, from coming off from the outer surface 5*a* of the electric wire 1. Particularly, in the electric wire 1 for use in a motor vehicle, since the coating layer 6 consists of water-soluble PVA, therefore the coloring agent CH is prevented from coming off from the outer surface 5*a* of the electric wire 1 even if the wires 1 are used in severe circumstances for a long period of time.

The thickness T of the coating layer 6 consisting of PVA is from 0.02 mm to 0.22 mm. Therefore, the coating layer 6 securely prevents the coloring agent CH, which forms the mark 23, from coming off from the outer surface 5*a* of the electric wire 1. Particularly, in the electric wire 1 for use in a motor vehicle, since the coating layer 6 consists of water-soluble PVA and is formed to have the thickness described above, therefore the coloring agent CH is securely prevented from coming off from the outer surface 5*a* of the electric wire 1 even if the wires 1 are used in severe circumstances for a long period of time.

The spouting unit 32 spouts the coating liquid C toward the outer surface 5*a* of the wire 1 with a specific amount thereof at a time. Therefore, the distance and the amount for spouting the coating liquid C can be adjusted according to the necessary thickness of the coating layer 6. Therefore, the coating liquid C can effectively adhere to the outer surface 5*a* of the wire 1. Therefore, the coating layer 6 can be formed without wasting the coating liquid C.

The encoder 33 detects the moving speed of the wire 1. The CPU 47 allows the spouting unit 32 to spout the coating liquid C toward the coloring agent adhering on the outer surface 5*a* of the wire 1 on the basis of the moving speed of the wire 1. Therefore, the coating layer 6 is securely formed on the coloring agent adhering on the outer surface 5*a* of the wire 1. Therefore, the coloring agent adhering on the outer surface 5*a* of the electric wire 1 is securely prevented from coming off as time passing. Further, by forming the coating layer 6 on the coloring agent, the coating liquid C can effectively adhere to the outer surface 5*a* of the wire 1. Therefore, the coating layer 6 can be formed without wasting the coating liquid C.

The coating device 3 is mounted on the electric wire-cutting device 2. Therefore, when the long wire 1 is cut into a specific length, the coating layer 6 can be formed on the outer surface 5*a* of the wire 1, thereby reducing a space for placing devices and man-hour for processing the wire 1.

In the preferred embodiment described above, the coating layer 6 consists of PVA. However, instead, the coating layer 6 may consist of ethylene-vinylalcohol copolymer (i.e. EVA copolymer). In this case, the coating agent constituting the coating liquid C consists of EVA copolymer, which constitutes the coating layer 6. The solvent for dissolving the coating agent may be toluene, xylene or hexane. The solvent for dissolving the coating agent can be appropriately selected according to the EVA copolymer used as the coating agent.

The solvent described above is heated and the EVA copolymer is dissolved in the heated solvent, thereby obtaining the coating liquid C. A concentration of the coating liquid C received in the coating liquid-supplying source 41 is set to be a concentration so that a solvent consisting of the EVA copolymer is not deposited when temperature of the coating liquid is returned to an ordinary temperature.

If the coating layer 6 consists of EVA copolymer, a thickness of the coating layer 6 is from 0.03 mm to 0.175 mm.

The coating layer 6 is formed on the marks 23 that are formed on the outer surface 5*a* of the wire 1. The coating layer 6 consists of EVA copolymer. Since the dye of the coloring liquid or the pigment of the coating material as the coloring agent CH is oil-soluble, the coloring agent CH hardly passes through the coating layer 6 consisting of water-soluble EVA copolymer. Therefore, the coating layer 6 prevents the coloring agent CH, which forms the marks 23, from coming off from the outer surface 5*a* of the electric wire 1. Particularly, in the electric wire 1 for use in a motor vehicle, since the coating layer 6 consists of water-soluble EVA copolymer, therefore the coloring agent CH is prevented from coming off from the outer surface 5*a* of the electric wire 1 even if the wires 1 are used in severe circumstances for a long period of time.

The thickness T of the coating layer 6 consisting of EVA copolymer is from 0.03 mm to 0.175 mm. Therefore, the coating layer 6 securely prevents the coloring agent CH, which forms the mark 23, from coming off from the outer surface 5*a* of the electric wire 1. Particularly, in the electric wire 1 for use in a motor vehicle, since the coating layer 6 consists of water-soluble EVA copolymer and is formed to have the thickness described above, therefore the coloring agent CH is securely prevented from coming off from the outer surface 5*a* of the electric wire 1 even if the wires 1 are used in severe circumstances for a long period of time.

A degree of color-coming-off of the coloring agent was measured when the coating layer 6 is formed with various materials. The result is shown in Table 1.

TABLE 1

| | Color Difference when thickness of coating layer is 0.1 mm | Evaluation |
|---|---|---|
| Example A | 2 | good |
| Example B | 10 | good |
| Comparative Example A | 43 | no good |
| Comparative Example B | 38 | no good |
| Comparative Example C | 48 | no good |
| Comparative Example D | 53 | no good |
| Comparative Example E | 49 | no good |
| Comparative Example F | 66 | no good |
| Comparative Example G | 84 | no good |

In the measurement, coating liquids C consisting of various materials were spouted with a specific amount thereof at a time toward an outer surface of a sheet material 100*a* (shown in FIGS. 10A and 10B), which consists of the same material as that of the coating 5 of the wire 1 and the outer surface of which is colored similarly to the wire 1, from the spouting unit 32 of the coating device 3. Thereby, the coating layer 6 was formed on a surface of the sheet material 100*a*.

Figure 10A:
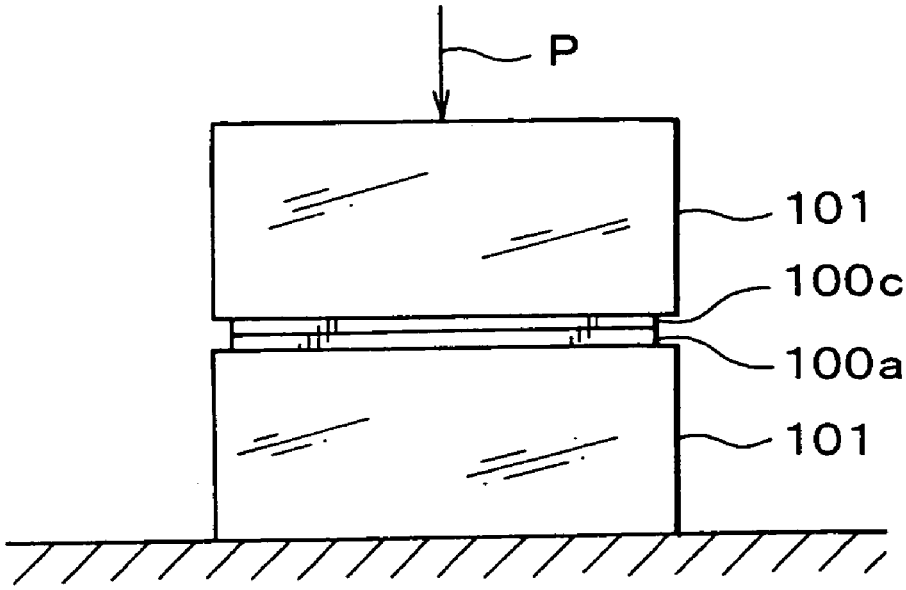
FIG. 10A is a schematic view illustrating a condition when the degree of color-coming-off shown in FIG. 9 is measured.
Figure 10B:
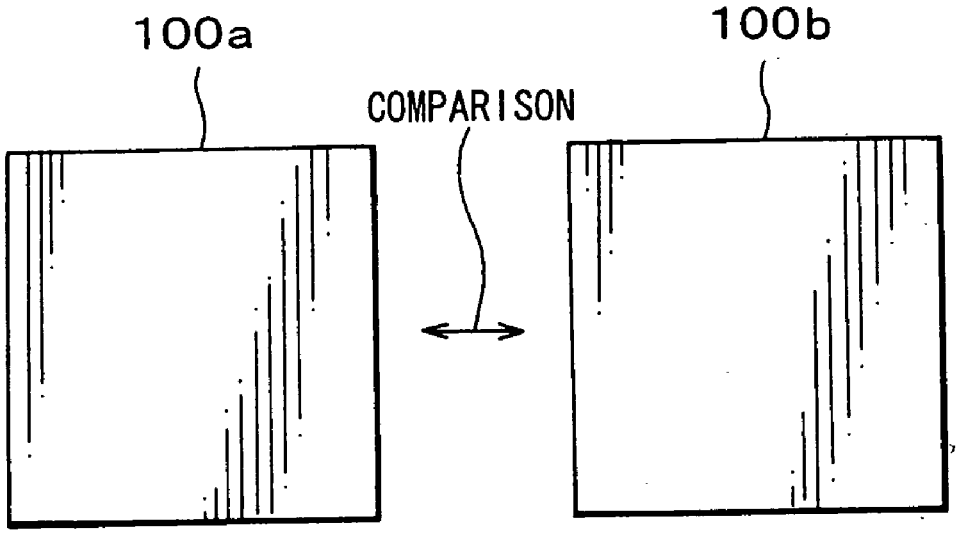
FIG. 10B is a plan views illustrating a sheet material used in FIG. 10A and a comparative sheet material.

When the coating layers 6 consisting of the various respective materials were formed, the degrees of coming-off of the coloring agent CH from the outer surface were measured. The thickness T of the coating layer 6 was set to be 0.1 mm. In the measurement, as shown in FIG. 10A, the sheet material 100*a* was piled together with a sheet material 100*c*, which consisted of the same material as that of the coating 5 of the wire 1 and not colored and on which the coating layer 6 was not formed. These sheet materials 100*a* and 100*c* were put between a pair of members 101 consisting of glass or the like. Then, a pressure P (for example 140 kgf/cm$^2$) was applied thereon in a direction in which the sheet materials 100*a* and 100*c* approach toward each other.

Then, on the condition that the pressure P was applied, the sample was left in a room that was heated at 80° C. for 24 hours. Thereafter, a color of the outer surface of the sheet material 100*c* and a color of the outer surface of the sheet material 100*b*, which was not colored similarly to the sheet material 100*c*, were compared with each other. Thereby, the degree of color transferred from the sheet material 100*a* to the sheet material 100*c* was measured. Here, the sheet material 100*b* was a sheet material, which consisted of the same material as that of the coating 5 of the wire 1 and was not colored similarly to the sheet material 100*c* and on which the coating layer 6 was not formed. The sheet material 100*b* was neither subjected to the pressurization nor heating as described above.

The color difference (ΔE) shown in Table 1 indicates the degree of the coloring agent transferred from under the coating layer 6 of the sheet material 100*a*, which was subjected to the condition shown in FIG. 10A for 24 hours, to the sheet material 100*c* in comparison with the sheet material 100*b* (shown in FIG. 10B) as a standard. That is, the color difference (ΔE) indicates the degree of coming-off of the coloring agent (hereinafter, color-coming-off) existed under the coating layer 6 of the sheet material 100*a*, which was subjected to the condition shown in FIG. 10A for 24 hours, from the outer surface.

Table 1 reveals that if the color difference (ΔE) increases, that is, if the color-coming-off increases, the coloring agent comes off from the outer surface, causing a decrease in the effect of the coating layer 6. In other words, if the color difference (ΔE) decreases, that is, if the color-coming-off decreases, the coloring agent hardly comes off from the outer surface, causing an increase in the effect of the coating layer 6.

In Table 1, in Comparative Example A, the coating layer 6 consisted of polyolefin. In Comparative Example B, the coating layer 6 consisted of urethane. In Comparative Example C, the coating layer 6 consisted of silicone resin. In Comparative Example D, the coating layer 6 consisted of acrylic resin. In Comparative Example E, the coating layer 6 consisted of natural rubber. In Comparative Example F, the coating layer 6 consisted of fluorine resin. In Comparative Example G, the coating layer 6 consisted of lacquer. That is, in these Comparative Examples A–G, each coating layer 6 was oil-soluble, which was not water-soluble.

In Table 1, in Example A, the coating layer 6 consisted of polyvinylalcohol (PVA). In Example B, the coating layer 6 consisted of ethylene-vinylalcohol copolymer (EVA copolymer).

If the color difference (ΔE) exceeds 68, it means that the color-coming-off is larger than that of a sheet material having no coating layer 6 formed thereon. That is, if the color difference (ΔE) exceeds 68, it means that there is no effect of the coating layer 6.

If the color difference (ΔE) is less than 20, it means that the coloring agent hardly comes off. Further, if the color difference (ΔE) is less than 10, it means that the coloring agent never comes off.

Table 1 reveals that in Comparative Example G the color difference (ΔE) exceeded 68, indicating that there was no effect of the coating layer 6. Further, Table 1 reveals that in the Comparative Examples A–F the color difference (ΔE) exceeded 20, indicating that the effect of the coating layer 6 was not sufficient, that is, the coating layer could not prevent the color-coming-off of the coloring agent from occurring. On the other hand, in the Examples A and B the color difference (ΔE) was not more than 10, indicating that the coating layer could prevent the color-coming-off of the coloring agent from occurring.

According to the result shown in Table 1, if the coating layer 6 consists of PVA or EVA, the coloring agent CH hardly passes through the coating layer 6. That is, in such a case, the coating layer 6 can prevent the coloring agent that constitutes the mark 23 from coming off from the outer surface 5*a* of the wire 1, that is, the coating layer 6 can prevent the color-coming-off from occurring. Particularly, in the electric wire 1 for use in a motor vehicle, since the coating layer 6 consists of water-soluble PVA or EVA copolymer, therefore the coloring agent is prevented from coming off from the outer surface 5*a* of the electric wire 1 even if the wires 1 are used in severe circumstances for a long period of time.

Figure 9:
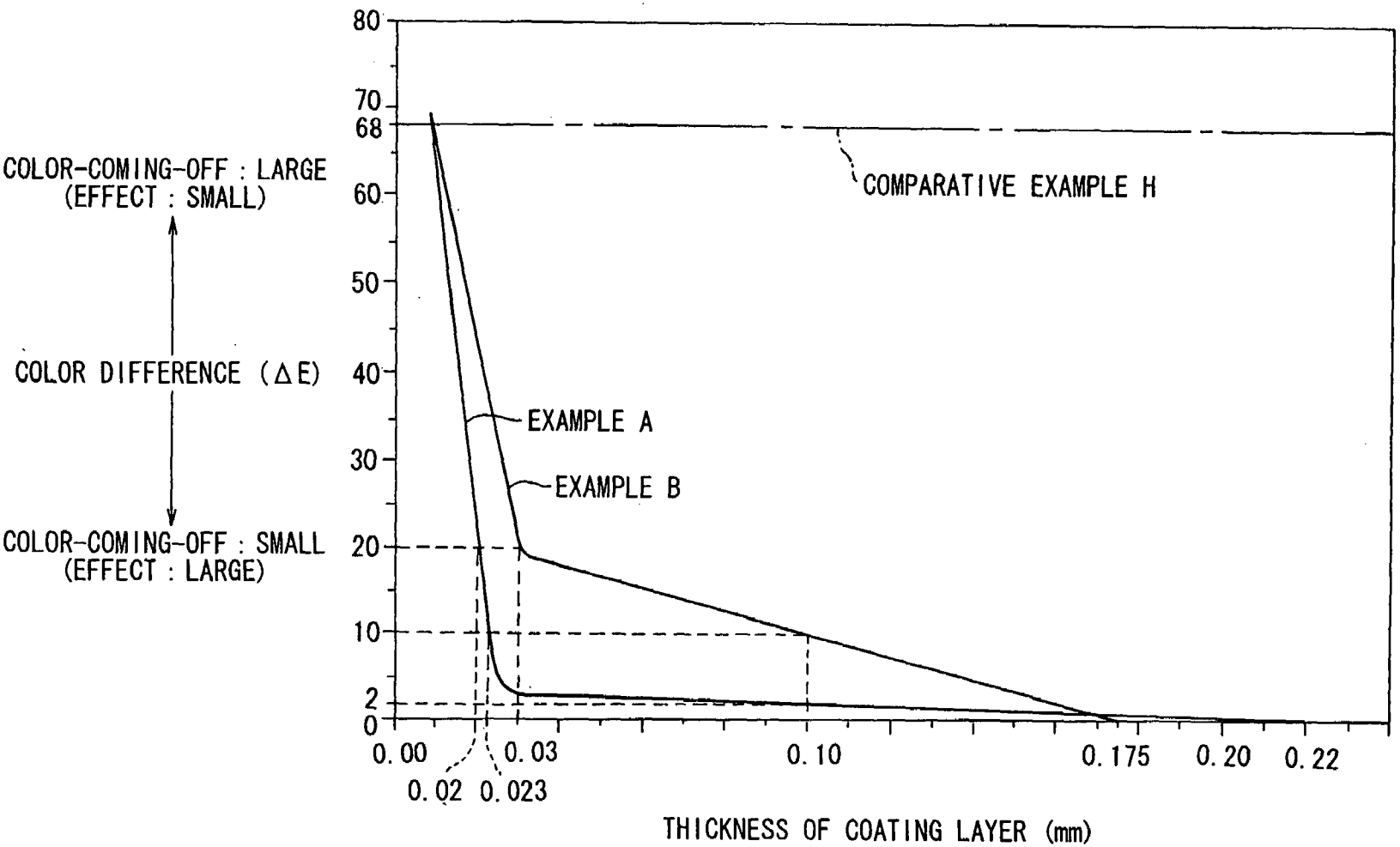
FIG. 9 is a graph illustrating a change in a degree of color-coming-off of a coloring agent when a thickness of a coating layer of the electric wire shown in FIG. 5 is changed.

Further, the degree of color-coming-off of the coloring agent was measured when the thickness T of the coating layer consisting of PVA or EVA copolymer was changed. The result is shown in FIG. 9. The measurement, the result of which being shown in FIG. 9, was carried out on the same condition as that of the measurement, the result of which being shown in Table 1.

In Comparative Example H shown in FIG. 9, the coating layer 6 was not formed. In Example A shown in FIG. 9, the coating layer consisted of PVA. In Example B shown in FIG. 9, the coating layer consisted of EVA copolymer.

According to the result shown in FIG. 9, for both of Examples A and B, when the thickness T of the coating layer 6 was increased, the coloring agent hardly came off. In Example A, when the thickness T was from 0.02 mm to 0.22 mm, the color difference (ΔE) was not more than 20. Further, when the thickness T was from 0.023 mm to 0.22 mm, the color difference (ΔE) was not more than 10.

That is, in Example A, if the thickness T of the coating layer 6 was from 0.02 mm to 0.22 mm, the color-coming-off of the coloring agent hardly occurred. Further, in Example A, if the thickness T of the coating layer 6 was from 0.023 mm to 0.22 mm, the color-coming-off of the coloring agent never occurred.

In Example B, when the thickness T was from 0.03 mm to 0.175 mm, the color difference (ΔE) was not more than 20. Further, when the thickness T was from 0.1 mm to 0.175 mm, the color difference (ΔE) was not more than 10.

That is, in Example B, if the thickness T of the coating layer 6 was from 0.03 mm to 0.175 mm, the color-coming-off of the coloring agent hardly occurred. Further, in Example B, if the thickness T of the coating layer 6 was from 0.1 mm to 0.175 mm, the color-coming-off of the coloring agent never occurred.

In the preferred embodiment described above, the coating layer 6 consisting of PVA is set to have the thickness T from 0.02 mm to 0.22 mm. However, the thickness T of the coating layer 6 consisting of PVA may be set from 0.023 mm to 0.22 mm.

In the latter case, as shown in FIG. 9, the color difference (ΔE) is not more than 10. That is, the coloring agent CH very hardly passes through the coating layer 6. That is, the coating layer 6 can more securely prevent the coloring agent CH that constitutes the mark 23 from coming off from the outer surface 5*a* of the wire 1, that is, the coating layer 6 can more securely prevent the color-coming-off of the coloring agent CH from occurring. Particularly, in the electric wire 1 for use in a motor vehicle, since the coating layer 6 consists of water-soluble PVA and is formed to have the thickness T as described above, therefore the coloring agent CH is more securely prevented from coming off from the outer surface 5*a* of the electric wire 1 even if the wires 1 are used in severe circumstances for a long period of time.

Further, in the preferred embodiment described above, the coating layer 6 consisting of EVA copolymer is set to have the thickness T from 0.03 mm to 0.175 mm. However, the thickness T of the coating layer 6 consisting of EVA copolymer may be set from 0.1 mm to 0.175 mm.

In the latter case, as shown in FIG. 9, the color difference (ΔE) is not more than 10. That is, the coloring agent CH very hardly passes through the coating layer 6. That is, the coating layer 6 can more securely prevent the coloring agent CH that constitutes the mark 23 from coming off from the outer surface 5*a* of the wire 1, that is, the coating layer 6 can more securely prevent the color-coming-off of the coloring agent CH from occurring. Particularly, in the electric wire 1 for use in a motor vehicle, since the coating layer 6 consists of water-soluble EVA copolymer and is formed to have the thickness T as described above, therefore the coloring agent CH is more securely prevented from coming off from the outer surface 5*a* of the electric wire 1 even if the wires 1 are used in severe circumstances for a long period of time.

In the preferred embodiment described above, only one coloring agent-spouting unit 31 is provided. However, instead, a plurality of the coloring agent-spouting units 31 may be provided so that the marks 23 are formed with a plurality of the coloring agents, that is, with a plurality of colors.

In the preferred embodiment described above, the control device 34 is constituted by a computer including the ROM 45, RAM 46, CPU 47 and so on. However, instead, the control device 34 may be constituted by a known digital circuit and so on. In the latter case, a circuit for counting the pulse-shaped signals transmitted from the encoder 33 and a circuit for judging that the valves 36, 40 be opened or closed when the pulse-shaped signal of which turn is inputted are preferably used.

In the preferred embodiment described above, the wires 1 that constitute a wiring harness to be mounted on a motor vehicle are described. However, the wires 1 can be used for various electronic instruments or electrical machines such as a portable computer besides the motor vehicle.

Further, in the present invention, as the coloring liquid or coating material, various material may be used, such as acrylic coating material, ink (dye or pigment) and UV-ink.

INDUSTRIAL APPLICABILITY

In the electric wire of the present invention, the coating layer is formed on the mark formed on the outer surface of the electric wire. The coating layer consists of polyvinylalcohol. Since the dye of the coloring liquid and the pigment of the coating material as the coloring agent are oil-soluble, the coloring agent hardly passes through the coating layer consisting of water-soluble polyvinylalcohol. Therefore, the coating layer prevents the coloring agent, which forms the mark, from coming off from the outer surface of the electric wire. Particularly, in the electric wire for use in a motor vehicle, since the coating layer consists of water-soluble polyvinylalcohol, therefore the coloring agent is prevented from coming off from the outer surface of the electric wire even if the wires are used in severe circumstances for a long period of time.

In the electric wire of the present invention, a thickness of the coating layer is from 0.02mm to 0.22 mm. Therefore, the coating layer securely prevents the coloring agent, which forms the mark, from coming off from the outer surface of the electric wire. Particularly, in the electric wire for use in a motor vehicle, since the coating layer consists of water-soluble polyvinylalcohol and is formed to have the thickness described above, therefore the coloring agent is securely prevented from coming off from the outer surface of the electric wire even if the wires are used in severe circumstances for a long period of time.

In the electric wire of the present invention, a thickness of the coating layer is from 0.023 mm to 0.22 mm. Therefore, the coating layer more securely prevents the coloring agent, which forms the mark, from coming off from the outer surface of the electric wire. Particularly, in the electric wire for use in a motor vehicle, since the coating layer consists of water-soluble polyvinylalcohol and is formed to have the thickness described above, therefore the coloring agent is more securely prevented from coming off from the outer surface of the electric wire even if the wires are used in severe circumstances for a long period of time.

In the electric wire of the present invention, the coating layer is formed on the mark formed on the outer surface of the electric wire. The coating layer consists of ethylene-vinylalcohol copolymer. Since the dye of the coloring liquid and the pigment of the coating material are oil-soluble, the coloring agent hardly passes through the coating layer consisting of water-soluble ethylene-vinylalcohol copolymer. Therefore, the coating layer prevents the coloring agent, which forms the mark, from coming off from the outer surface of the electric wire. Particularly, in the electric wire for use in a motor vehicle, since the coating layer consists of water-soluble ethylene-vinylalcohol copolymer, therefore the coloring agent is prevented from coming off from the outer surface of the electric wire even if the wires are used in severe circumstances for a long period of time.

In the electric wire of the present invention, a thickness of the coating layer is from 0.03 mm to 0.175 mm. Therefore, the coating layer securely prevents the coloring agent, which forms the mark, from coming off from the outer surface of the electric wire. Particularly, in the electric wire for use in a motor vehicle, since the coating layer consists of water-soluble ethylene-vinylalcohol copolymer and is formed to have the thickness described above, therefore the coloring agent is securely prevented from coming off from the outer surface of the electric wire even if the wires are used in severe circumstances for a long period of time.

In the electric wire of the present invention, a thickness of the coating layer is from 0.1 mm to 0.175 mm. Therefore, the coating layer more securely prevents the coloring agent, which forms the mark, from coming off from the outer surface of the electric wire. Particularly, in the electric wire for use in a motor vehicle, since the coating layer consists of water-soluble ethylene-vinylalcohol copolymer and is formed to have the thickness described above, therefore the coloring agent is more securely prevented from coming off from the outer surface of the electric wire even if the wires are used in severe circumstances for a long period of time.

The invention claimed is:

1. An electric wire comprising:

an electrically conductive core wire;

a coating consisting of polyvinyl chloride for coating the core wire;

a mark formed on a part of an outer surface of the coating by allowing an oil-soluble coloring agent to adhere to the part; and a coating layer formed on the mark and the outer surface of the coating, the coating layer coating the mark, wherein the coating layer consists of polyvinylalcohol.

2. The electric wire according to claim 1, wherein a thickness of the coating layer is from 0.02 mm to 0.22 mm.

3. The electric wire according to claim 1, wherein a thickness of the coating layer is from 0.023 mm to 0.22 mm.

4. An electric wire comprising:

an electrically conductive core wire;

a coating consisting of polyvinyl chloride for coating the core wire;

a mark formed on a part of an outer surface of the coating by allowing an oil-soluble coloring agent to adhere to the part; and a coating layer formed on the mark and the outer surface of the coating, the coating layer coating the mark, wherein the coating layer consists of an ethylene-vinylalcohol copolymer.

5. The electric wire according to claim 4, wherein a thickness of the coating layer is from 0.03 mm to 0.175 mm.

6. The electric wire according to claim 4, wherein a thickness of the coating layer is from 0.1 mm to 0.175 mm.

* * * * *